US007604271B2

(12) United States Patent
Giannini

(10) Patent No.: US 7,604,271 B2
(45) Date of Patent: Oct. 20, 2009

(54) SHOE, BOOT AND SKATE HOLDER

(75) Inventor: Ambrogio Giannini, Russell, MA (US)

(73) Assignee: Scuderi Group, LLC, West Springfield, MA (US)

( * ) Notice: Subject to any disclaimer, the term of this patent is extended or adjusted under 35 U.S.C. 154(b) by 306 days.

(21) Appl. No.: 11/589,369

(22) Filed: Oct. 30, 2006

(65) Prior Publication Data

US 2008/0100009 A1 May 1, 2008

(51) Int. Cl.
*A45F 5/00* (2006.01)

(52) U.S. Cl. ..... 294/158; 294/162; 294/165

(58) Field of Classification Search ..... 294/15, 294/137, 145, 158, 159, 160, 162, 165, 168; 224/103

See application file for complete search history.

(56) References Cited

U.S. PATENT DOCUMENTS

| | | | | | |
|---|---|---|---|---|---|
| 1,190,152 | A | * | 7/1916 | Gross | 211/59.1 |
| 1,212,087 | A | * | 1/1917 | Mikell | 224/103 |
| 2,324,638 | A | * | 7/1943 | O'Connor | 70/65 |
| 2,398,896 | A | * | 4/1946 | How et al. | 294/158 |
| 2,861,727 | A | * | 11/1958 | Veres | 224/103 |
| 5,020,759 | A | * | 6/1991 | Weber | 248/309.2 |
| 5,899,514 | A | * | 5/1999 | York et al. | 294/146 |

* cited by examiner

*Primary Examiner*—Dean J Kramer
(74) *Attorney, Agent, or Firm*—Fildes & Outland, P.C.

(57) ABSTRACT

A shoe, boot and skate holder includes a handle, a stem extending from the handle, and a locking mechanism operatively connected to the stem. An eyelet rod is releasably lockable in the locking mechanism. The eyelet rod is insertable through eyelets of a shoe, boot or skate, and is lockable in the locking mechanism to retain the shoe, boot or skate in the holder.

11 Claims, 9 Drawing Sheets

SHOE, BOOT AND SKATE HOLDER

TECHNICAL FIELD

This invention relates to holding and carrying devices for footwear, and more particularly to a holder for shoes, boots and skates.

BACKGROUND OF THE INVENTION

It can be difficult and cumbersome to transport footwear, such as boots or ice skates, to and from a location where the footwear is to be used. For example, boots and skates tend to be relatively large and heavy, and it is often necessary to carry a pair of boots and skates one in each hand. This leaves a person carrying the boots or skates without a free hand to accomplish other simple tasks such as opening doors or to carry any other items such as a toolbox, lunchbox, duffle bag, and the like.

One known method of carrying a pair of shoes, boots, or skates is to tie together an end of a lace of one of the shoes, boots, or skates with an end of a lace of the other shoes, boots, or skates. A person can then carry the pair of footwear by grasping the tied-together laces. This method, however, has deficiencies. For example, the laces may become so tightly knotted together that it is difficult and time consuming to untie the laces when it is desired to use the footwear again. Also, if the laces are of any appreciable length, the footwear may dangle close to the ground while being carried, or worse, may scrape along the ground. Furthermore, when carried in this manner, the footwear hang loosely from the laces and may easily become disrupted, causing the footwear to sway back and forth and to undesirably bump into other nearby objects.

Therefore, there is a need for a device that allows a person to easily and securely carry a pair of footwear such as shoes, boots, or skates in one hand.

SUMMARY OF THE INVENTION

The present invention provides a footwear holder for holding and carrying footwear having lace eyelets such as but not limited to shoes, boots, ice skates, inline skates (i.e., "roller blades"), and the like. The shoe, boot and skate holder in accordance with the invention securely holds a pair of footwear by one or more eyelet rods that can be passed through the lace eyelets of the footwear. The shoe, boot and skate holder also includes a handle that can be grasped by one hand to allow a user to easily transport the pair of footwear from one location to another.

More particularly, a shoe, boot and skate holder in accordance with the invention includes a handle, a stem extending from the handle, and a locking mechanism operatively connected to the stem. An eyelet rod is releasably lockable in the locking mechanism. The eyelet rod is insertable through eyelets of a shoe, boot or skate, and is lockable in the locking mechanism to retain the shoe, boot or skate in the holder. The eyelet rod may be operatively connected to the stem at an end of the rod.

In one embodiment, the stem includes a bifurcation forming first and second prongs. Further, the eyelet rod has first and second ends. The eyelet rod first end is coupled with the first prong and the eyelet rod second end is releasably coupleable with the second prong. The eyelet rod is insertable through eyelets of footwear such as shoes, boots, and skates, and releasably latchable to the second prong to retain the footwear in the holder.

The second prong may include a loop at a terminal end, and the eyelet rod second end may include a hook releasably coupled to the loop of the second prong. The stem may be yieldable, and yielding the second prong outwardly may allow for release of the eyelet rod second end from the second prong. The eyelet rod first end may include a loop, and the first prong may include a hook at a terminal end coupled with the loop of the eyelet rod. The eyelet rod may have a diameter sized to fit through an eyelet of a shoe, boot, or skate.

In a separate embodiment, the shoe, boot and skate holder includes a handle, a stem extending from the handle, a first eyelet rod, and a second eyelet rod. A locking assembly is mounted on the stem. The first and second eyelet rods are releasably engagable with the locking assembly. The first and second eyelet rods are each insertable through eyelets of footwear and releasably engagable in the locking assembly to retain the footwear in the holder.

Optionally, the first and second eyelet rods may be operatively connected to the stem by elongated, flexible members.

The locking assembly may include a sleeve having a threaded outer surface and the sleeve may be mounted on the stem. The locking assembly may also include a housing having a first threaded aperture sized to receive the sleeve and a second aperture opposite the first aperture sized to receive the stem. The sleeve is received in the first threaded aperture and the housing is mounted on the stem through the second aperture. The locking assembly may further include a clamping member having a threaded aperture. The housing includes an opening, and the clamping member is received in the opening. The sleeve is fixedly received in the threaded aperture of the clamping member. The housing opening and the clamping member form a pair of adjustable slots for receiving and locking the first and second eyelet rods. A wing nut may be engaged with the threaded outer surface of the sleeve. The wing nut is rotatable about the sleeve and the stem. Inserting the first and second eyelet rods into the slots and rotating the wing nut into engagement with the housing releasably engages the first and second eyelet rods in the slots.

The stem may include a stop that holds the housing on the stem. The clamping member may be fixed to the sleeve by a locking pin. The slots may include grooved surfaces cooperable with the first and second eyelet rods. The clamping member may be block shaped.

These and other features and advantages of the invention will be more fully understood from the following detailed description of the invention taken together with the accompanying drawings.

DETAILED DESCRIPTION OF THE INVENTION

Figure 1:
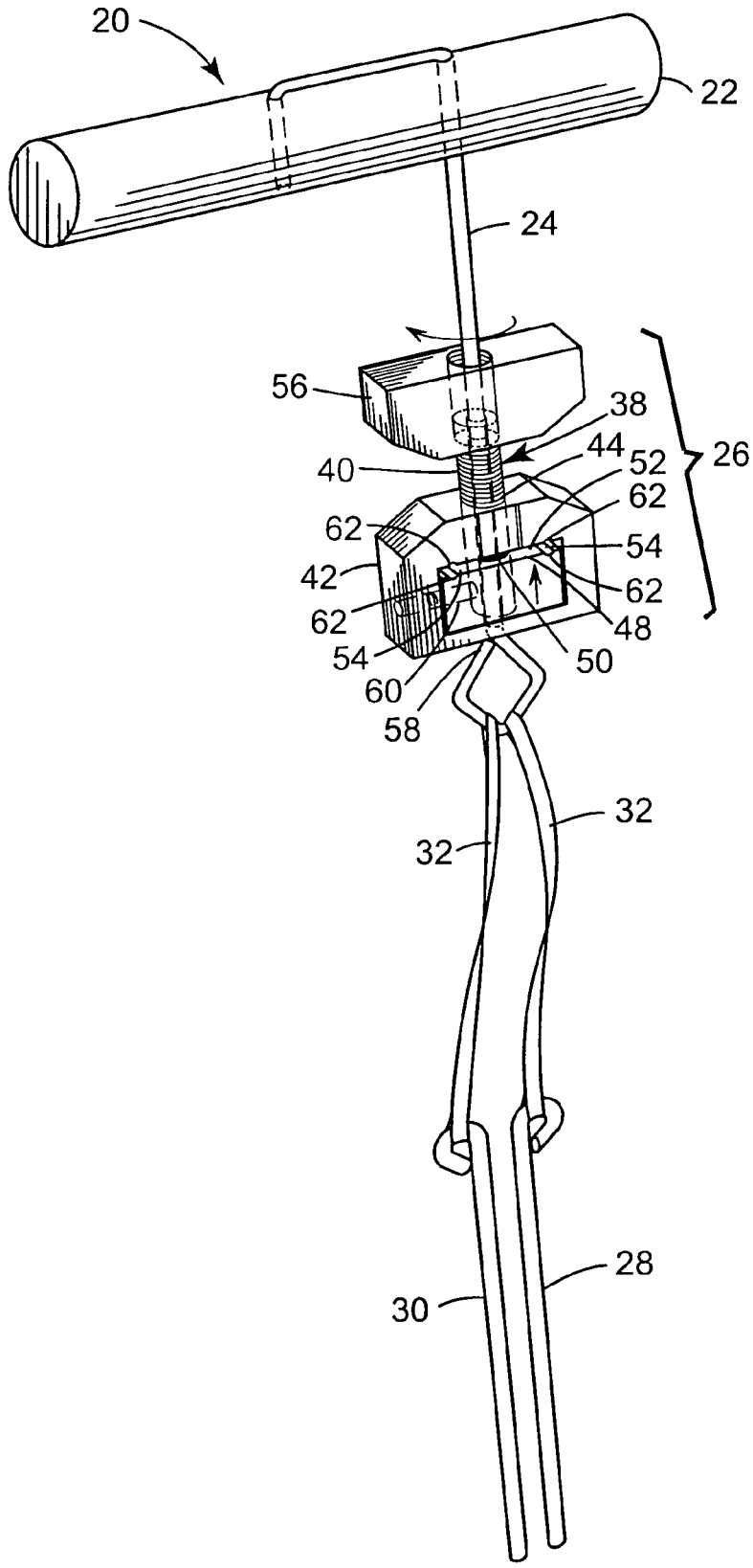
FIG. 1 is a perspective view of a first embodiment of a shoe, boot and skate holder in accordance with the invention.
Figure 2:
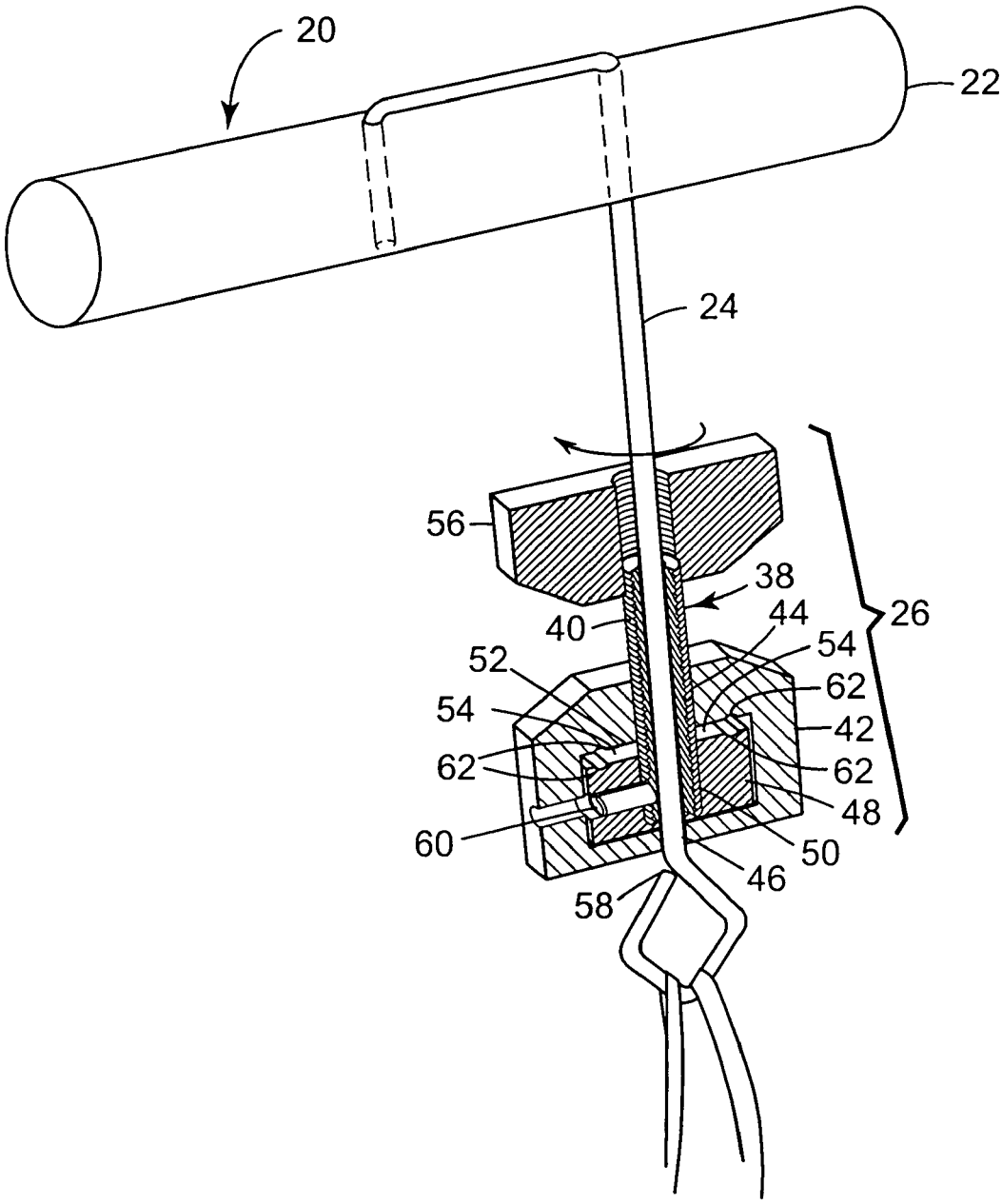
FIG. 2 is a partial perspective view of the shoe, boot and skate holder of FIG. 1 illustrating a locking assembly of the holder in cross-section.
Figure 3:
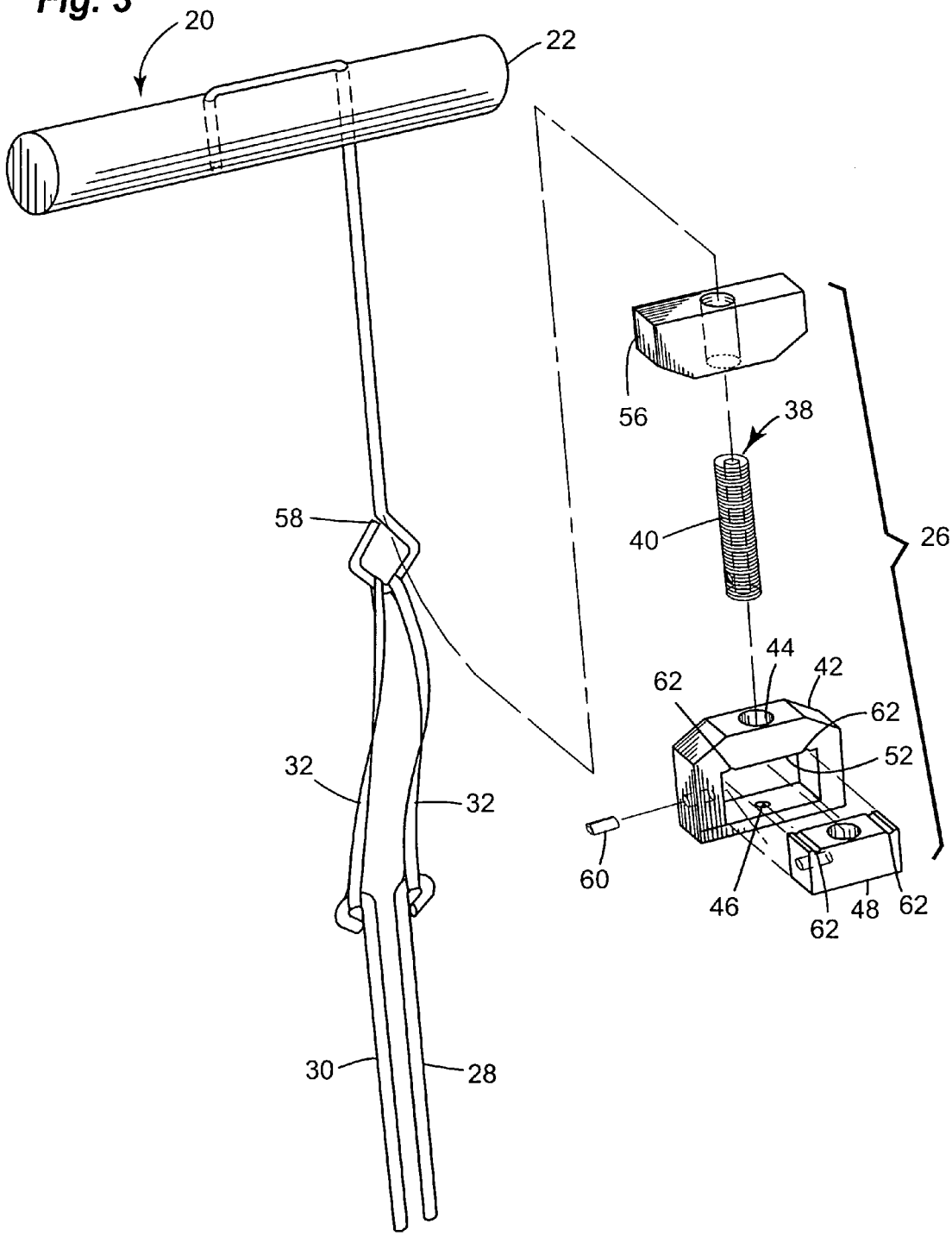
FIG. 3 is another view of the shoe, boot and skate holder of FIG. 1 wherein the locking assembly is shown in an exploded view.

Referring now to the drawings in detail, numeral 20 generally indicates a shoe, boot and skate holder in accordance with the invention. The shoe, boot and skate holder 20 allows for easy holding and transport of a pair of footwear such as a pair of shoes, boots, ice skates, or similar. A person can utilize the shoe, boot and skate holder 20 to carry the pair of footwear by gripping the holder 20 with a single hand, leaving the person's other hand free to perform other tasks.

With reference first to FIGS. 1 through 8, in a first embodiment a shot, boot and skate holder 20 in accordance with the invention includes a handle 22 and a stem 24 extending from the handle 22. A locking mechanism such as a locking assembly 26 is operatively connected to the stem 24. For example, the locking assembly 26 may be mounted on the stem 24.

The shoe, boot and skate holder 20 further includes a first eyelet rod 28 and a second eyelet rod 30. The first and second eyelet rods 28, 30 are releasably engagable with the locking assembly 26. The first and second eyelet rods 28, 30 may be operatively connected to the stem 24 by elongated, flexible members 32 such as strings, ropes, laces, ties, elastic bands, or other similar elongated members. Alternatively, the first and second eyelet rods 28, 30 may not be connected to the stem 24. The first and second eyelet rods 28, 30 are each insertable through eyelets 34 of footwear such as a pair of boots 36 and releasably engagable in the locking assembly 26 to retain the footwear in the holder. The eyelet rods 28, 30 may therefore have a diameter sized to fit through footwear eyelets 34. Also, it should be understood that the footwear may be any type footwear having eyelets that are large enough to receive the eyelet rods 28, 30. Hence, in addition to boots, the footwear may be shoes, ice skates, inline skates ("roller blades"), and the like.

The locking assembly 26 of the holder 20 may include a sleeve 38 having a threaded outer surface 40. The sleeve 38 may be mounted on the stem 24. The locking assembly 26 may also include a housing 42 having a first threaded aperture 44 sized to receive the sleeve 38 and a second aperture 46 opposite the first aperture 44 sized to receive the stem 24. The sleeve 38 is received in the first threaded aperture 44 and the housing 42 is mounted on the stem 24 through the second aperture 46. The locking assembly 26 may further include a clamping member 48 having a threaded aperture 50. The housing 42 includes an opening 52, and the clamping member 48 is received in the opening 52. The sleeve 38 is fixedly received in the threaded aperture 50 of the clamping member 48. The housing opening 52 and the clamping member 48 form a pair of adjustable slots 54 for receiving and locking the first and second eyelet rods 28, 30. A wing nut 56 may be engaged with the threaded outer surface 40 of the sleeve 38. The wing nut 56 is rotatable about the sleeve 38 and the stem 24. Inserting the first and second eyelet rods 28, 30 into the slots 54 and rotating the wing nut 56 into engagement with the housing 42 releasably engages the first and second eyelet rods 28, 30 in the slots 54.

The stem 24 of the locking assembly 26 may include a stop 58 that holds the housing 42 on the stem 24. Further, the clamping member 48 may be fixed to the sleeve 38 by a locking pin 60 and may be block shaped. Also, the slots 54 may include grooved surfaces 62 cooperable with the first and second eyelet rods 28, 30.

Figure 4:
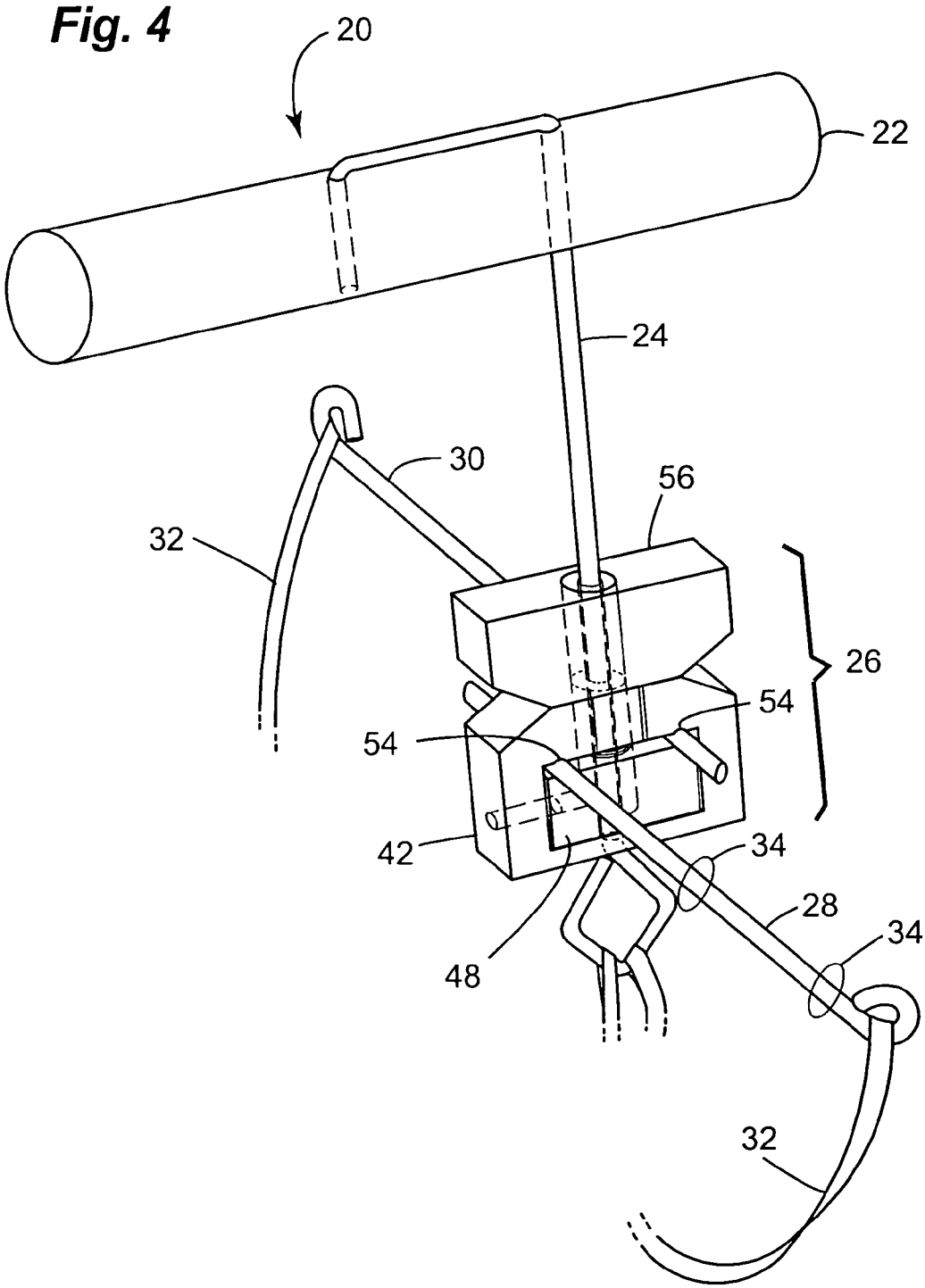
FIG. 4 is a partial perspective view of the shoe, boot and skate holder of FIG. 1 illustrating eyelet rods of the holder engaged with the locking assembly.
Figure 5:
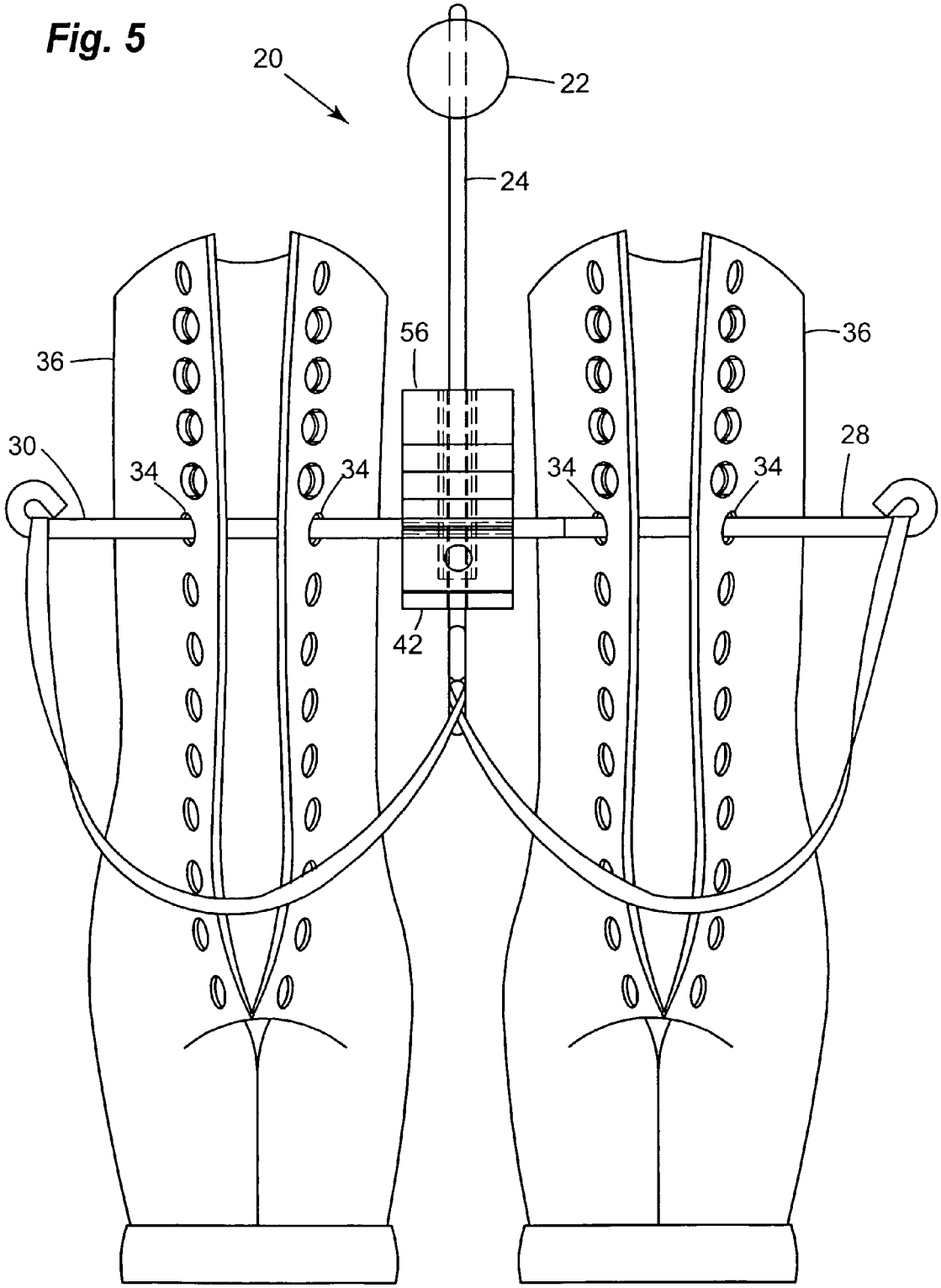
FIG. 5 is an environmental view of the shoe, boot and skate holder of FIG. 1 illustrating the holder in a locked position securely holding a pair of boots.
Figure 6:
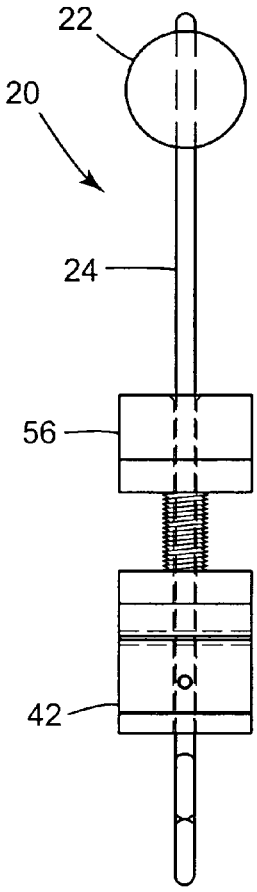
FIG. 6 is a partial side view of the shoe, boot and skate holder of FIG. 1 illustrating the locking assembly in an unlocked position.
Figure 7:
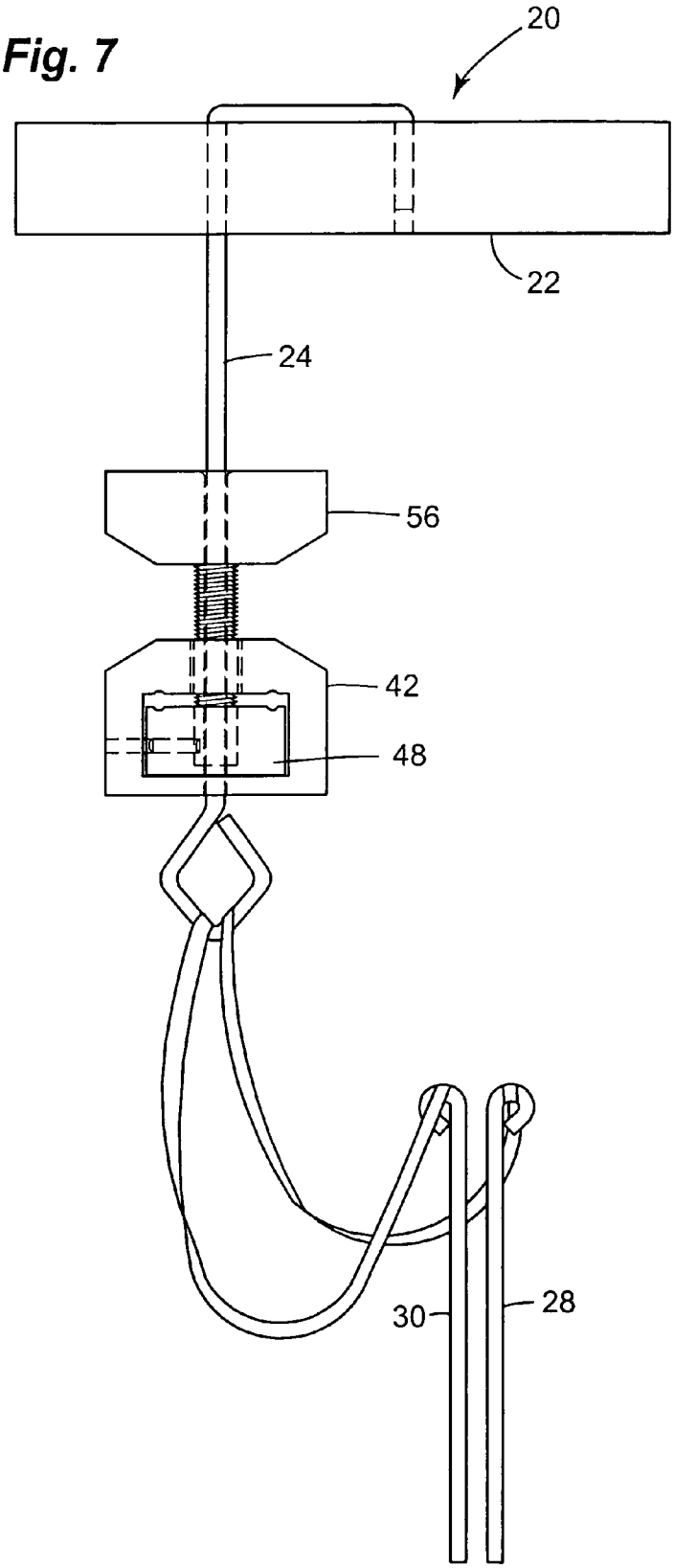
FIG. 7 is another side view of the shoe, boot and skate holder of FIG.1 illustrating the locking assembly in an unlocked position.
Figure 8:
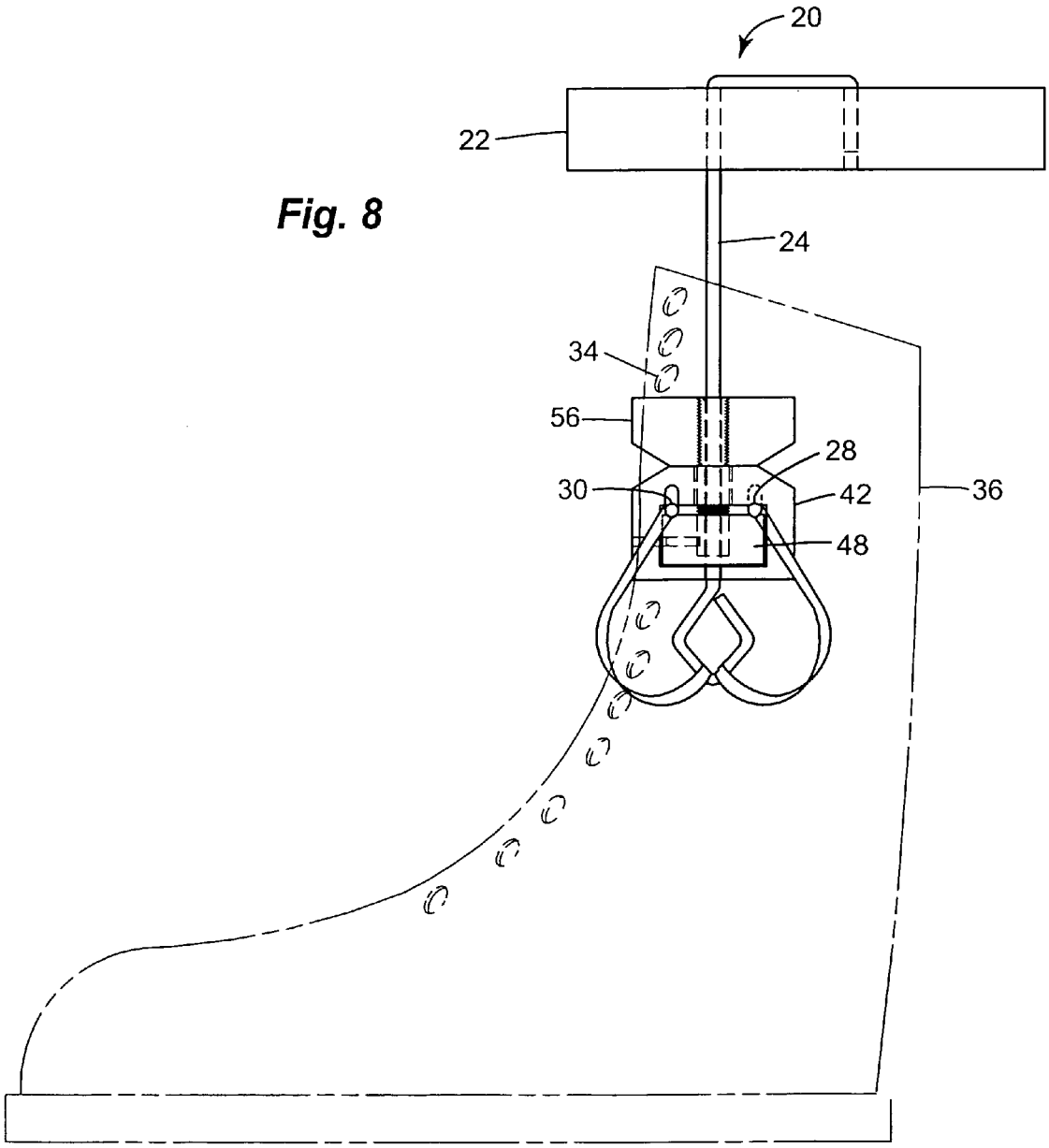
FIG. 8 is a view similar to FIG. 5 illustrating the holder in a locked position holding a boot.

As shown in FIGS. 4, 5, and 8, to secure a pair of footwear such as boots 36 to the holder 20, a user grasps the first eyelet rod 28 and inserts an end of the first rod 28 through at least one, preferably more than one, eyelet 34 of the boot 36. For example, the first eyelet rod 28 may be inserted through two eyelets 34 that are opposite each other. The end of the first eyelet rod 28 is then inserted through one of the adjustable slots 54, preferably along the grooved surfaces 62 of the slot 54. Similarly, the user grasps the second eyelet rod 30 and inserts an end of the second rod 30 through at least one (preferably more than one) eyelet 34 of the other boot 36 of the pair. The end of the second eyelet rod 30 is then inserted through the other of the adjustable slots 54, preferably along the grooved surfaces 62 of the slot 54. After the first and second eyelet rods 28 are inserted in the slots 54, the user then rotates the wing nut 56 about the sleeve 38 as illustrated by a curved arrow in FIG. 1. As the wing nut 56 rotates into engagement with the housing 42, the clamping member 48 is drawn towards the wing nut 56 to tighten the eyelet rods 28, 30 in the slots 54 as illustrated by a straight arrow in FIG. 1. Generally, the slots 54 are adjustable in the sense that as the clamping member 48 is drawn towards or released away from the wing nut 56, the sizes of the slots 54 become smaller or larger respectively. It should therefore be understood that the wing nut 56 and clamping member 48 should be in a released position prior to insertion of the eyelet rods 28, 30 in the slots 54 so that the slots are open to receive the eyelet rods.

Once the eyelet rods 28, 30 are secured in the slots 54, the user can grasp the holder 20 by the handle 22 and can carry and transport the secured boots 36 with one hand. To later release the boots 36, the user simply rotates the wing nut 56 away from the housing 42 and pulls the eyelet rods 28, 30 out of the slots 54 and the eyelets 34 of the boots 36. The holder 20 may then be stored for later use.

Figure 9:
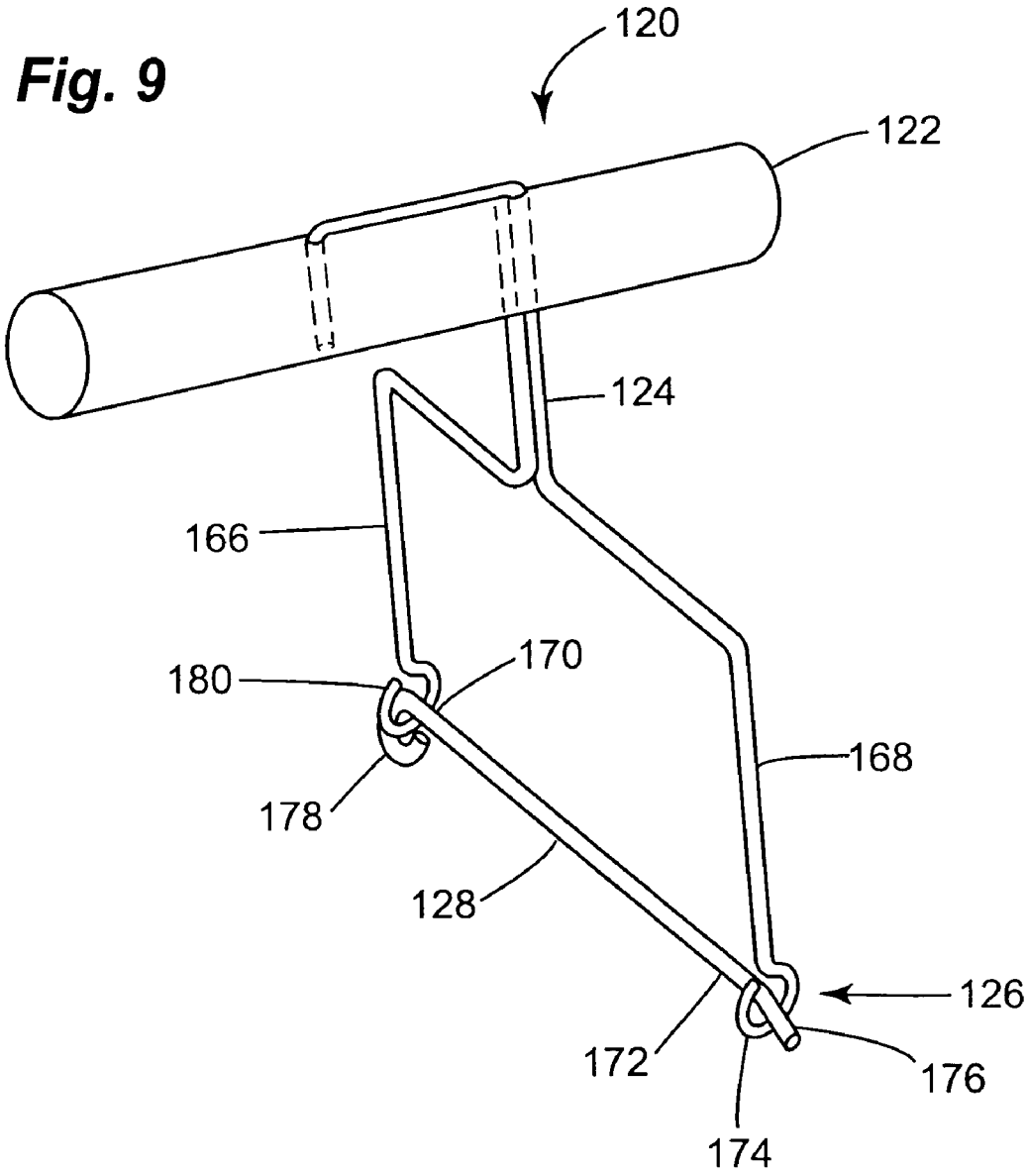
FIG. 9 is a perspective view of a second embodiment of a shoe, boot and skate holder in accordance with the invention.
Figure 10:
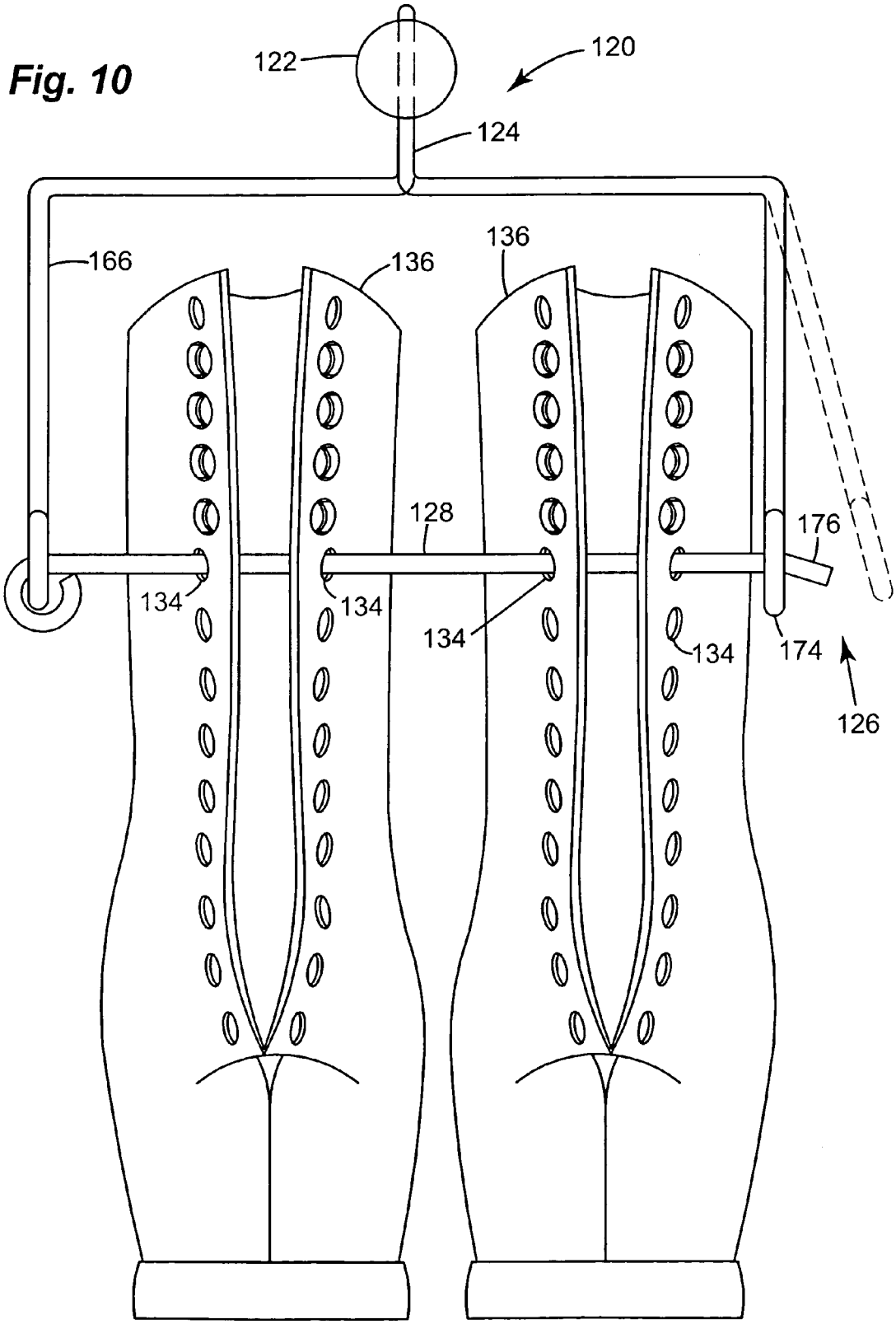
FIG. 10 is an environmental view of the shoe, boot and skate holder of FIG. 9 illustrating the holder in a locked position securely holding a pair of boots and illustrating unlocking of the holder in phantom.

Turning to FIGS. 9 and 10, in a second, alternative embodiment of the present invention, a shoe, boot and skate holder 120 includes a handle 122 and a stem 124 extending from the handle 122. A locking mechanism 126 is operatively connected to the stem 124. An eyelet rod 128 is operatively connected to the stem 124 at an end of the rod. The eyelet rod 128 is releasably lockable in the locking mechanism 126.

The stem 124 includes a bifurcation forming a first prong 166 and second prong 168. Further, the eyelet rod has a first end 170 and second end 172. The eyelet rod first end 170 is coupled with the first prong 166 and the eyelet rod second end 172 is releasably coupleable with the second prong 168. The eyelet rod 128 is insertable through eyelets 134 of a pair of footwear 136 such as a pair of shoes, boots, and skates, and releasably latchable to the second prong 168 to retain the footwear in the holder 120.

The second prong 168 may include a loop 174 at a terminal end, and the eyelet rod second end 172 may include a hook 176 releasably coupled to the loop 174 of the second prong. The stem 124 may be yieldable, and yielding the second prong 168 outwardly may allow for release of the eyelet rod second end 172 from the second prong. The eyelet rod first end 170 may include a loop 178, and the first prong 166 may include a hook 180 at a terminal end coupled with the loop 178 of the eyelet rod 128.

With reference specifically to FIG. 10, to secure a pair of footwear such as boots 136 in the holder 120, a user first pulls the second prong 168 outwardly to release the eyelet rod hook 176 from the loop 174 of the second prong 168. This frees the eyelet rod 128 from the second prong 168. The eyelet rod 128 may then be threaded through at least one eyelet 134 of each of the pair of boots 136. For example, the eyelet rod 128 may be inserted through two eyelets 134 of each boot 136. Next, the eyelet rod 128 is latched into the locking mechanism 126 by reinserting the eyelet rod hook 176 into the loop 174 of the second prong 168. The boots 136 are then secure in the holder 120 and the user may grip the holder 120 to carry and transport the boots 136.

To later release the boots 136 from the holder 120, the eyelet rod 128 is released from the locking mechanism 126 and the eyelet rod 128 is removed from the eyelets 134 of the boots 136. The eyelet rod 128 may then be reinserted into the locking mechanism 126 by latching the eyelet rod hook 176 in the loop 174 of the second prong 168.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A shoe, boot and skate holder comprising:

a handle;

a stem extending from said handle;

a locking mechanism operatively connected to said stem; and an eyelet rod releasably lockable in said locking mechanism;

said locking mechanism including:

a sleeve having a threaded outer surface, said sleeve being mounted on said stem;

a housing having a first threaded aperture sized to receive said sleeve and a second aperture opposite said first aperture sized to receive said stem, said sleeve being received in said first threaded aperture and said housing being mounted on said stem through said second aperture;

a clamping member having a threaded aperture;

said housing including an opening, said clamping member being received in said opening and said sleeve being fixedly received in said threaded aperture of said clamping member;

said housing opening and said damning member forming an adjustable slot for receiving and locking said eyelet rod; and a wing nut engaged with said threaded outer surface of said sleeve and, said wing nut being rotatable about said sleeve and said stem to adjust said slot;

whereby said eyelet rod is insertable through eyelets of one of a shoe, boot and skate, and said eyelet rod is lockable in said locking mechanism to retain said shoe, boot or skate in said holder.

2. The shoe, boot and skate holder of claim 1, wherein said eyelet rod is operatively connected to said stem at an end of said rod.

3. The shoe, boot and skate holder of claim 1, wherein said locking mechanism comprises a latch disposed at a terminal end of said stem.

4. The shoe, boot and skate holder of claim 1, including two eyelet rods releasably engagable with said locking mechanism.

5. The shoe, boot and skate holder of claim 1, wherein said eyelet rod has a diameter sized to fit through an eyelet of one of a shoe, boot and skate.

6. A shoe, boot and skate holder comprising:

a handle;

a stem extending from said handle;

a first eyelet rod and a second eyelet rod; and a locking assembly mounted on said stem;

said first and second eyelet rods being releasably engagable with said locking assembly and operatively connected to said stem by elongated, flexible members;

whereby said first and second eyelet rods are each insertable through eyelets of footwear and releasbly engagable in said locking assembly to retain said footwear in said holder.

7. The shoe, boot and skate holder of claim 6, wherein said locking assembly includes:

a sleeve having a threaded outer surface, said sleeve being mounted on said stem;

a housing having a first threaded aperture sized to receive said sleeve and a second aperture opposite said first aperture sized to receive said stem, said sleeve being received in said first threaded aperture and said housing being mounted on said stem through said second aperture;

a clamping member having a threaded aperture;

said housing including an opening, said clamping member being received in said opening and said sleeve being fixedly received in said threaded aperture of said clamping member;

said housing opening and said clamping member forming a pair of adjustable slots for receiving and locking said first and second eyelet rods; and a wing nut engaged with said threaded outer surface of said sleeve and, said wing nut being rotatable about said sleeve and said stem;

whereby inserting said first and second eyelet rods into said slots and rotating said wing nut into engagement with said housing releasably engages said first and second eyelet rods in said slots.

8. The shoe, boot and skate holder of claim 7, wherein said stem includes a stop that holds said housing on said stem.

9. The shoe, boot and skate holder of claim 7, wherein said clamping member is fixed to said sleeve by a locking pin.

10. The shoe, boot and skate holder of claim 7, wherein said slots include grooved surfaces cooperable with said first and second eyelet rods.

11. The shoe, boot and skate holder of claim 7, wherein said clamping member is block shaped.

* * * * *